US005285966A

United States Patent [19]

Czech

[11] Patent Number: 5,285,966

[45] Date of Patent: Feb. 15, 1994

[54] SPRAYING APPARATUS HAVING INTERNAL CHAMBER SELECTIVELY PRESSURIZED BY A PRESSURIZING DEVICE

[75] Inventor: Manuel Czech, Donaustauf, Fed. Rep. of Germany

[73] Assignee: Czewo-Plast Kunststofftechnik GmbH, Neutraubling, Fed. Rep. of Germany

[21] Appl. No.: 954,301

[22] Filed: Sep. 30, 1992

[30] Foreign Application Priority Data

Oct. 4, 1991 [DE] Fed. Rep. of Germany ..... 9112386.0[U]

[51] Int. Cl.[5] ..... B05B 9/04

[52] U.S. Cl. ..... 239/321; 239/373; 222/214; 222/340; 222/392

[58] Field of Search ..... 239/320, 321, 323, 350, 239/352, 373; 222/392, 336, 340, 214, 207

[56] References Cited

U.S. PATENT DOCUMENTS

| | | | |
|---|---|---|---|
| 3,042,981 | 7/1962 | Dilione | 239/350 |
| 3,114,483 | 12/1963 | Kappel | 239/350 |
| 3,235,135 | 2/1966 | Robert et al. | 239/350 |
| 3,471,065 | 10/1969 | Malone | 222/321 |
| 3,792,800 | 2/1974 | Capra et al. | 222/340 |
| 3,799,448 | 3/1974 | Nozawa et al. | 239/350 |
| 3,848,808 | 11/1974 | Fetty et al. | 239/327 |
| 4,182,496 | 1/1980 | Burke | 239/492 |
| 4,527,437 | 7/1985 | Wells | 222/214 |
| 4,723,725 | 2/1988 | Comment | 239/570 |
| 5,199,614 | 4/1993 | Husman | 222/340 |

FOREIGN PATENT DOCUMENTS

| | | | |
|---|---|---|---|
| 1959536 | 6/1970 | Fed. Rep. of Germany . | |
| 3733523 | 5/1989 | Fed. Rep. of Germany . | |
| 1503684 | 12/1967 | France | 239/350 |
| 2141332 | 1/1973 | France . | |
| 2318686 | 2/1977 | France . | |
| 2412353 | 7/1979 | France . | |

*Primary Examiner*—Karen B. Merritt
*Attorney, Agent, or Firm*—Nilles & Nilles

[57] ABSTRACT

To avoid the use of propellants which are harmful to the environment, a spraying apparatus employs a supply chamber which contains a material to be sprayed and includes a pressure chamber of variable volume. This pressure chamber of variable volume is connected to actuating structure which is provided for increasing the volume of the pressure chamber and thus for sucking material from the supply chamber into the pressure chamber. Since the material within the pressure chamber is kept under pressure by pressurizing structure, a nonreturn valve is disposed in the suction conduit leading to the supply chamber. Material can be sprayed with the aid of the spraying apparatus without any harmful effects on the environment, the use of conventional spraying heads being here possible.

25 Claims, 8 Drawing Sheets

SPRAYING APPARATUS HAVING INTERNAL CHAMBER SELECTIVELY PRESSURIZED BY A PRESSURIZING DEVICE

BACKGROUND OF THE INVENTION

Spraying apparatus are known, especially apparatus for spraying liquid material disposed within a material container. The spraying apparatus includes a pressure chamber from which the material is taken. A spraying head with a dispensing valve is provided for spraying the material.

As is generally known, propellants, such as fluorocarbon propellants that are very harmful to the environment, are used for producing pressure within a pressure chamber.

SUMMARY OF THE INVENTION

It is therefore the object of the present invention to provide a spraying apparatus of the above-mentioned kind for reliably dispensing material without the use of additional propellants.

The material within the spraying apparatus is thereby dispensed in a simple and reliable way, the use of additional propellants being in particular avoided.

An especially simple design of the actuating means is accomplished by equipping said means with an actuating cord whose one end is secured to the chamber bottom. In a simple embodiment, the chamber bottom can, e.g., be moved by pulling the actuating cord.

In a slightly improved embodiment the actuating means additionally comprises a winding spool to which the other end of the actuating cord is secured. The actuating cord can here be wound onto and unwound from the spool.

The winding spool is advantageously arranged in a housing below the material container and rotatably supported therein.

Furthermore, the actuating means can advantageously be actuated by rotating the winding spool for winding up the actuating cord from the outside of the housing.

In another advantageous embodiment the winding spool can be rotated by means of a driving spool connected thereto, and a pull cord is wound around the driving spool, one end thereof being fixed onto the driving spool and the other end thereof being adapted to be gripped from the outside. The driving spool can be rotated together with the winding spool by pulling the pull cord, and the actuating cord is wound around the winding spool, whereby the chamber bottom is moved.

To prevent the free end of the pull cord from disappearing in the housing which accommodates the spools, the end of the pull cord wound around the driving spool, i.e. the end to be gripped, is connected to a gripping means, in particular a ball.

The winding spool and the driving spool are made integral and are preferably formed as an injection molded part for an economic production of the parts of the actuating means.

For an easy transmission of the tensile force to the actuating cord, the diameter of the driving spool is made greater than the diameter of the winding spool.

The pull cord is advantageously brought back from the unwound state into the wound state with the aid of a return means which is arranged to this end and rotates the driving spool for winding up the cord. In a simple embodiment of the return means, the latter is formed as a spiral spring. The inner end of the spiral spring acts on the axis of the spool and the outer end is secured to a pin fixed within the housing.

The chamber bottom must follow the material dispensed from the pressure chamber for permanently pressurizing the sucked material. To this end, a resetting means is provided as a pressurizing means. In a simple embodiment this resetting means is formed as a helical spring which is arranged between the bottom of the material container and the chamber bottom of the pressure chamber.

The pressure chamber has a cylindrical configuration in a simple constructional embodiment, resulting in an especially simple tubular structure. In a preferred embodiment of the present invention, a bellows is arranged between the chamber bottom and the inner side of the pressure chamber for receiving the material to be dispensed. This bellows can be expanded or compressed in accordance with the movement of the pressure chamber bottom connected thereto. This has the advantage that no high demands have to be made on the sealing of the chamber bottom relative to the pressure chamber wall, which might lead to premature wear and failure of the spraying apparatus. Moreover, material cannot stick to the inner walls of the pressure chamber, i.e. a corresponding movement of the chamber bottom is always ensured.

To feed the pressure chamber in a simple way and to discharge the sucked material again, the upper end face of the pressure chamber has an opening serving both the inlet and outlet of the material.

To this end, suction conduit and dispensing duct have such a configuration that the suction conduit terminates in the dispensing duct and material is sucked in over part of the dispensing duct and material is dispensed through the whole dispensing duct.

When material is sucked into the pressure chamber, the volume of the pressure chamber is increased, whereby a vacuum which effects the suction of the material is created in the pressure chamber. On the other hand, an inner pressure which is higher than the ambient pressure is required for the discharge of the material because otherwise the material could not be sprayed out. When the amount of material decreases in the supply chamber and when the helical spring which forms the resetting means is released, the pressure in the pressure chamber drops. To exclude a pressure which is too low—such a pressure would no longer guarantee the spraying of material—a means is provided for closing the dispensing duct, so that despite a manual operation of the dispensing valve, material is no longer dispensed and the user is prompted to operate the actuating means.

In a preferred embodiment of this pressure regulation means, the latter is formed as a plunger which projects from the chamber bottom and comes into contact with the dispensing opening of the pressure chamber when the volume of the pressure chamber decreases and thereby closes the pressure chamber.

This has also the advantage that the pressure chamber is tightly sealed, so that no drying effects must be feared with respect to the liquid remaining in the pressure chamber.

For a safe and easy dispensing operation the pressure-regulation spray head which is already available in commercial form is used as the spraying head, so that no additional constructional efforts are needed.

Furthermore, the spraying head is arranged in a cover of the material container.

The cover and thus the spraying head can advantageously be detached, e.g. screwed off, so that when the material container is in its empty state, said container can be refilled with material, whereupon the material container is closed again by means of the cover and the spraying head is simultaneously connected again to the dispensing duct.

In an alternative embodiment, the spraying head may be designed as such a pressure-regulation spray head which comprises a pressure-dependent shut-off device for shutting off the dispensing duct. The shut-off device of the pressure-regulation spray head may e.g. be a piston whose position depends on the internal pressure and which closes the dispensing duct at a specific and low internal pressure.

In an alternative embodiment of the bellows, the chamber bottom may be formed as a sealing piston.

In another alternative embodiment, the resetting means may be formed as a rubber sleeve which is arranged inside the pump chamber and forms the inner circumferential wall thereof, the rubber sleeve being here firmly connected to the chamber bottom. The expanded rubber sleeve acts as a resetting means.

After material has been dispensed from the material container, the pressure inside the container drops because of the reduced amount of material. To permit a defined and reliable discharge of the material, a pressure compensating means is provided between the inner chamber of the material container and the surroundings of the spraying apparatus.

This means may e.g. be an opening formed in the container wall. In a preferred embodiment the pressure compensating means is designed as a pressure-dependent sealing lip.

In an alternative embodiment the actuating means may be constructed such that it comprises a lever rod which is hinged to the upper circumferential area of the spraying apparatus and whose free lower end is connected to the other end of the actuating cord. When the lower end of the lever rod is moved away from the material container, the actuating cord moves out of the container, whereby the chamber bottom is moved downwards.

In another embodiment a cap which is connected via a rod to the chamber bottom is arranged on the lower wall portion of the spraying apparatus. Pins which engage a screw-shaped groove in the cap are arranged on the wall portion. For sucking purposes the cap is rotated downwards, a pressure spring which pressurizes the chamber bottom being stretched at the same time. Since the groove has a pitch which does not permit any self-locking between pin and groove, the cap is simultaneously moved upwards along with an upward movement of the chamber bottom when material is sprayed. It can be seen from the position of the cap how much material is still left within the pressure chamber.

BRIEF DESCRIPTION OF THE DRAWINGS

Other details, features and advantages of the present invention will become apparent from the following description taken in conjunction with the drawing, in which.

DETAILED DESCRIPTION OF THE PREFERRED EMBODIMENTS

Figure 1:
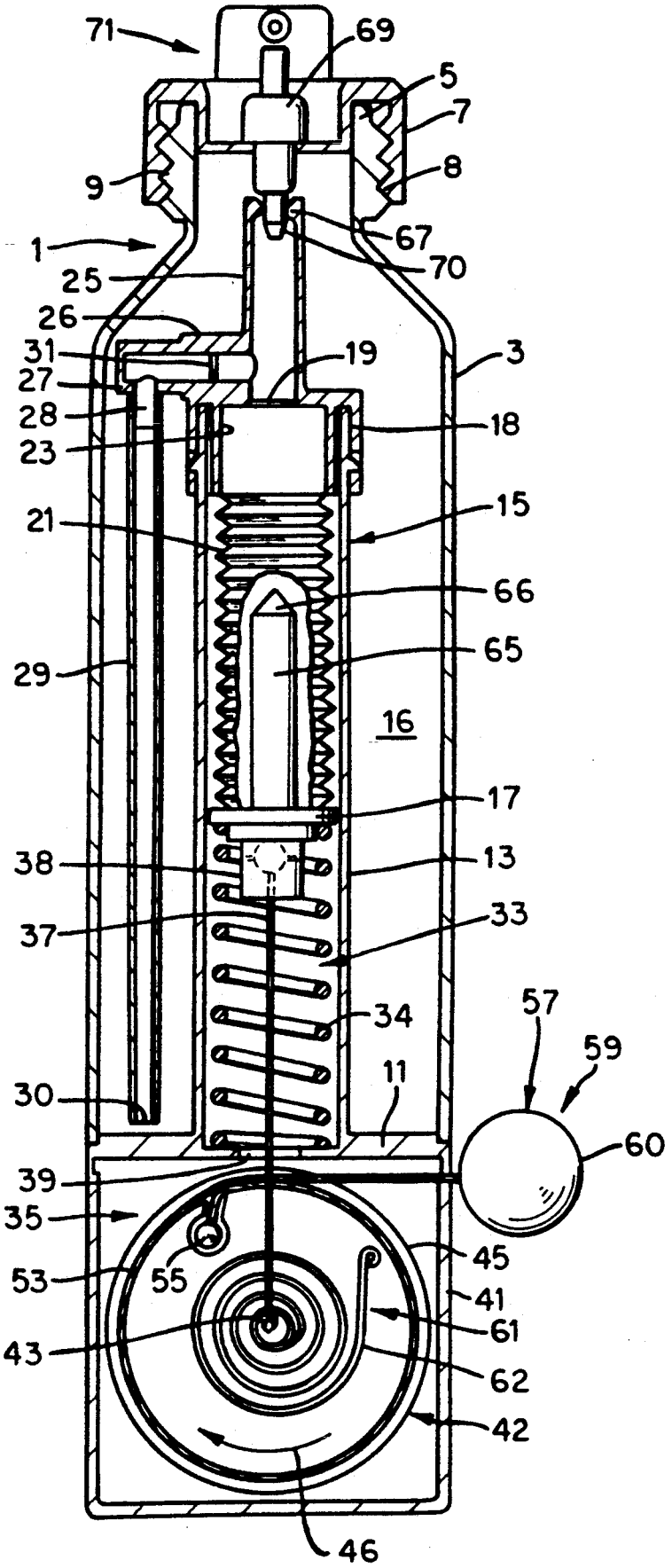
FIG. 1 is a sectional view of a preferred embodiment of the spraying apparatus.

The configuration of a first embodiment of the spraying apparatus shall now be described with reference to FIG. 1.

The spraying apparatus 1 comprises a material container 3 of substantially cylindrical shape. The material container 3 has an upper opening 5 which can be closed by means of a cover 7. The upper opening 5 of the material container 3 and the cover 7 may, e.g., be connected through a corresponding internal thread 8 and a corresponding external thread 9.

The material container 3 has a container bottom 11 which closes the material container 3. A cylindrical tube 13 which is preferably integral with the container bottom 11 extends from the container bottom 11. A pressure chamber which is formed as a pump chamber 15 is arranged in the upper area of the cylindrical tube 13.

The pump chamber 15 is defined at its lower end by a chamber bottom 17 and has a chamber cover 18 at its upper end.

The chamber cover 18 includes an opening 19 which permits sucked material to enter into the pump chamber 15 and permits the discharge thereof from the pump chamber during the dispensing operation.

The pump chamber 15 has disposed therein a bellows 21 which is firmly connected to the chamber bottom 17 on the one hand and clamped at the upper end between a circumferential wall 23 projecting downwards from the chamber cover 18 and the inner wall of the cylindrical tube 13. This results in a pump chamber for the material. The chamber cover 18 is also provided with a dispensing duct 25 which extends upwards from the opening 19. A suction conduit 27 terminates laterally in the dispensing duct 25.

The suction conduit 27 comprises a downwardly projecting nozzle 28 which has connected thereto a suction tube 29 extending in parallel with the cylindrical tube 13 and comprising a suction opening 30 which is arranged near the container bottom 11. As a result, the material in the material container 3 can be sucked off almost entirely.

The space which surrounds the cylindrical tube 13 and extends up to the container wall serves as a supply chamber 16 for the material.

In a preferred embodiment the chamber cover 18, the dispensing duct 25 and a nozzle 26 for receiving the suction conduit 27 are integrally formed, in particular as an injection molded part.

The suction conduit 27 has disposed therein a nonreturn valve 31 which only permits the passage of material towards opening 19, but shuts off the suction conduit 27 when the material moves in the opposite direction. This prevents the material in duct 25 from flowing back into the supply chamber 16.

A resetting means 33 which is shaped as a helical spring 34 is provided in the cylindrical tube 13 between the chamber bottom 17 and the container bottom 11.

The chamber bottom 17 is moved downwards for the purpose of moving the chamber bottom 17 and for increasing the pump chamber 15, i.e. for sucking material from the supply chamber 16 into the pump chamber 15. This is effected with the help of an actuating means 35.

The actuating means 35 comprises an actuating cord 37 which acts on a peg-shaped attachment 38 projecting downwards from the chamber bottom 17. The actuating cord 37 extends through an opening 39 in the container bottom 11 into a housing 41. A compound spool body 42 which comprises a winding spool 43 and a driving spool 45 is provided in the housing. The construction of these spools becomes especially apparent from FIG. 3. Winding spool 43 and driving spool 45 are formed as an integral element, preferably in the form of an injection molded part. The spool body 42 is rotatably mounted in a corresponding holding device 47. A projecting pin 49 is arranged on this holding device 47, and a pin 51 which rotates with the spool body 42 is provided in the area of the bearing of the spool body 42.

As becomes especially apparent from FIG. 1, a pull cord 53 is wound around the driving spool 45. An end 55 of the pull cord is fixed in the driving spool 45 whereas the other end extends through an opening to the outside of the housing. The end 57 of the pull cord 53 is connected to a gripping means 59 which is formed as a ball 60 in the illustrated embodiment.

Any desired design is here possible, e.g. a loop at end 57 or a small plate, etc.

Furthermore, the actuating means 35 has a return means 61 shaped in the form of a spiral spring 62. The inner end of the spiral spring is position-secured in the slotted pin 51 whereas the outer end of the spiral spring 62 is bent over onto itself, thereby forming an eye 63 which is placed around the pin 49.

If ball 60 is pulled, the driving spool 45 rotates in the direction of arrow 46, whereby the actuating cord is wound onto the winding spool 43. As a consequence, the actuating cord 37 pulls the chamber bottom 17 downwards, whereby the volume of the pump chamber 15 is increased. The increased volume of the pump chamber creates a vacuum, so that the material within the supply chamber 16 is sucked through the suction opening 30 into the suction tube 29 due to the pressure difference existing between the supply chamber 16 and the pump chamber 15. The fluid drawn into tube 29 then flows through the suction conduit 27 and the opening 19 into the pump chamber 15.

The length of the pull cord 53 is dimensioned such that the chamber bottom 17 is in its lowermost position when the pull cord is fully pulled out, and the resetting means 33 is maximally compressed by the helical spring 34.

As becomes also apparent from FIG. 1, a plunger 65 which has a conically converging upper tip 66 is provided in the pump chamber 15, starting from the chamber bottom 17. When material is dispensed, the pump chamber 15 becomes smaller again due to upward motion of chamber bottom 17, the conical tip 66 coming into contact with the opening 19 and closing the same.

Furthermore, an opening 67 into which the tip of a valve assembly 69 penetrates is provided at the upper end of the discharge duct 25. The opening 67 surrounds a tip 70 in a substantially tight fashion. Tip 70, in turn, has a duct formed therein.

The valve assembly 69 may be of a conventional type and is described in more detail further below with reference to FIG. 11.

The valve assembly 69 is arranged in a spraying head, preferably a pressure-regulation spray head 71 which, in turn, is arranged in the cover 7 so that is can be attached and removed together with the cover 7.

The pressure-regulation spraying head is of a conventional type and is manually operated for dispensing material.

Identical parts are designated by identical reference numerals in the figures described in the following text.

Figure 2:
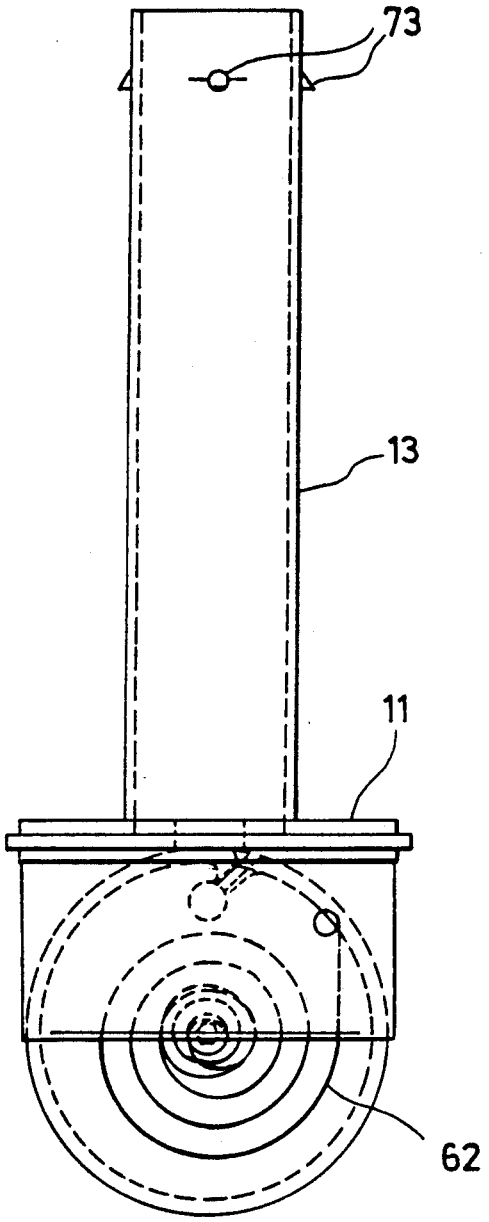
FIG. 2 is a top view of the pressure chamber and partly of the actuating means, taken in the same viewing direction as in FIG. 1.
Figure 3:
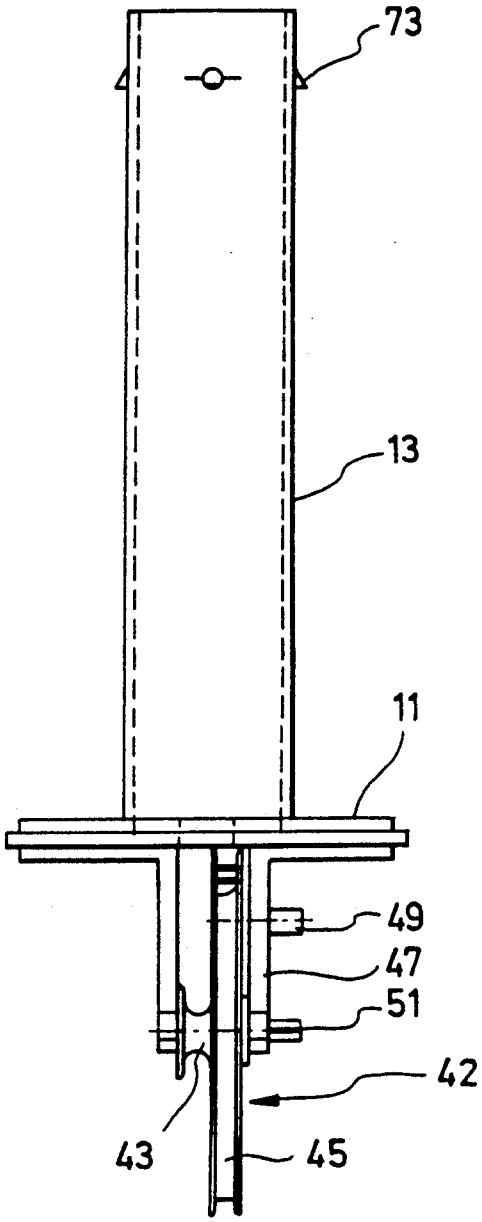
FIG. 3 is a view of FIG. 2 offset by 90°.
Figure 4:
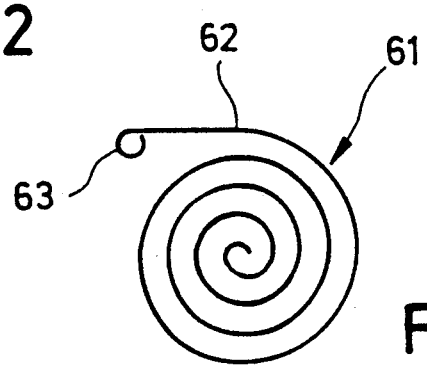
FIG. 4 shows an embodiment of the return means.

As becomes apparent from FIGS. 2 and 3, the cylindrical tube 13 is made integral with the bottom 11 of the material container 3. Noses 73 are provided for securing the position of the chamber cover 18. Corresponding openings into which the noses 73 can be snapped in place are provided in the chamber cover 18.

Hence, a simple and therefore inexpensive construction is possible owing to the simple structure of the cylindrical tube 13 and the container bottom 11 and the integrally formed holding device 47 for the spool body 42.

Figure 5:
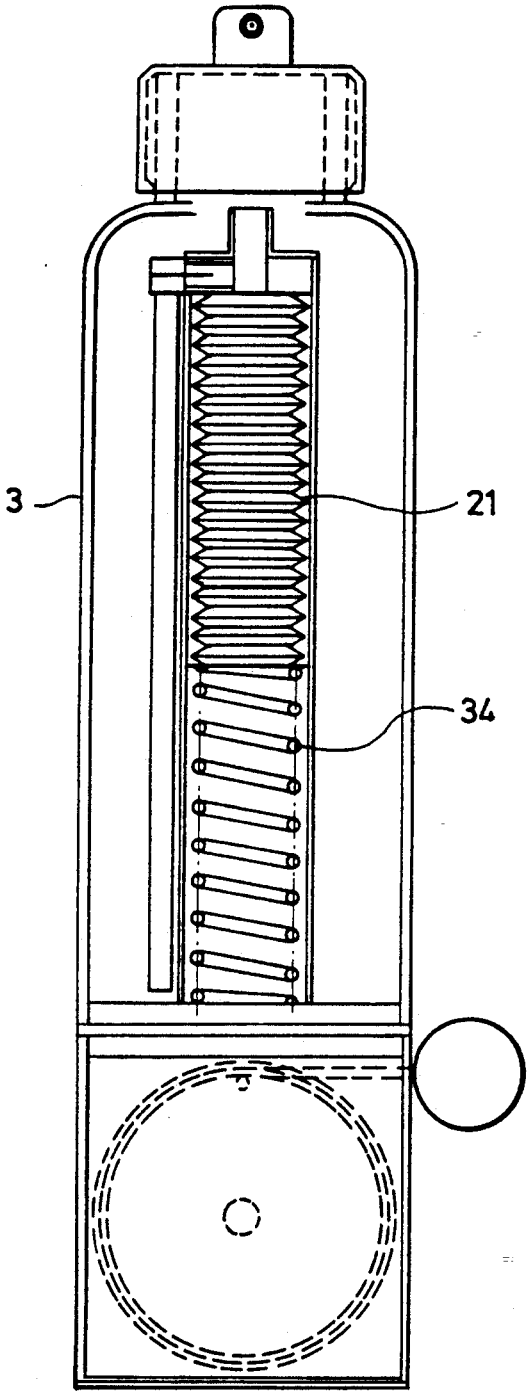
FIG. 5 is a diagrammatic illustration of the spraying apparatus with the bellows filled and the spring compressed.
Figure 6:
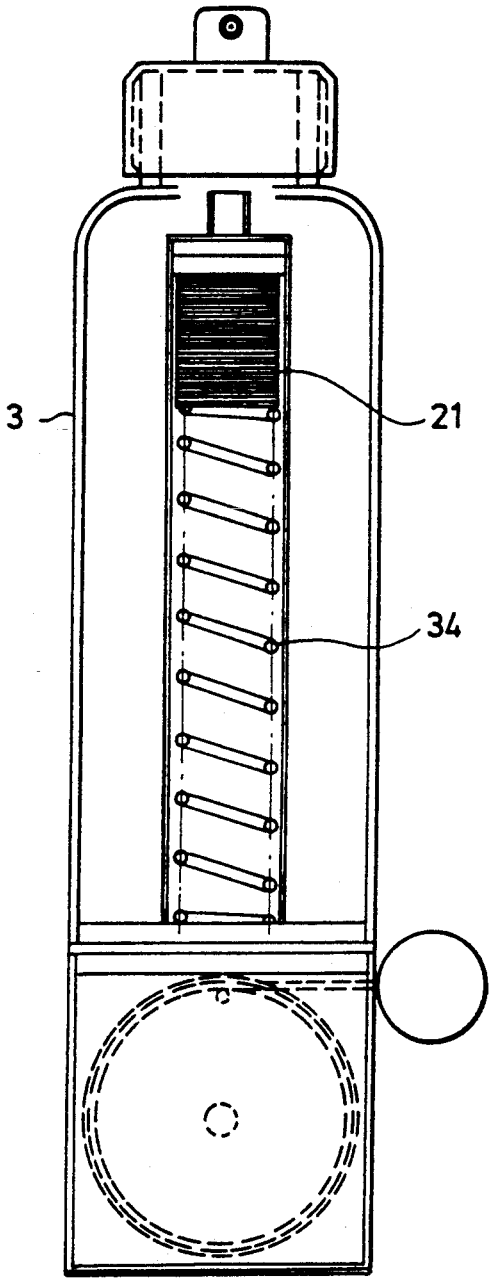
FIG. 6 shows the embodiment of FIG. 5 with the bellows folded and spring released.

FIGS. 5 and 6 diagrammatically illustrate two operative positions of the spraying apparatus. FIG. 5 shows the filler bellows 21 filler with the spring 34 compressed whereas FIG. 6 shows the spring 34 released and the bellows 21 folded.

Figure 7:
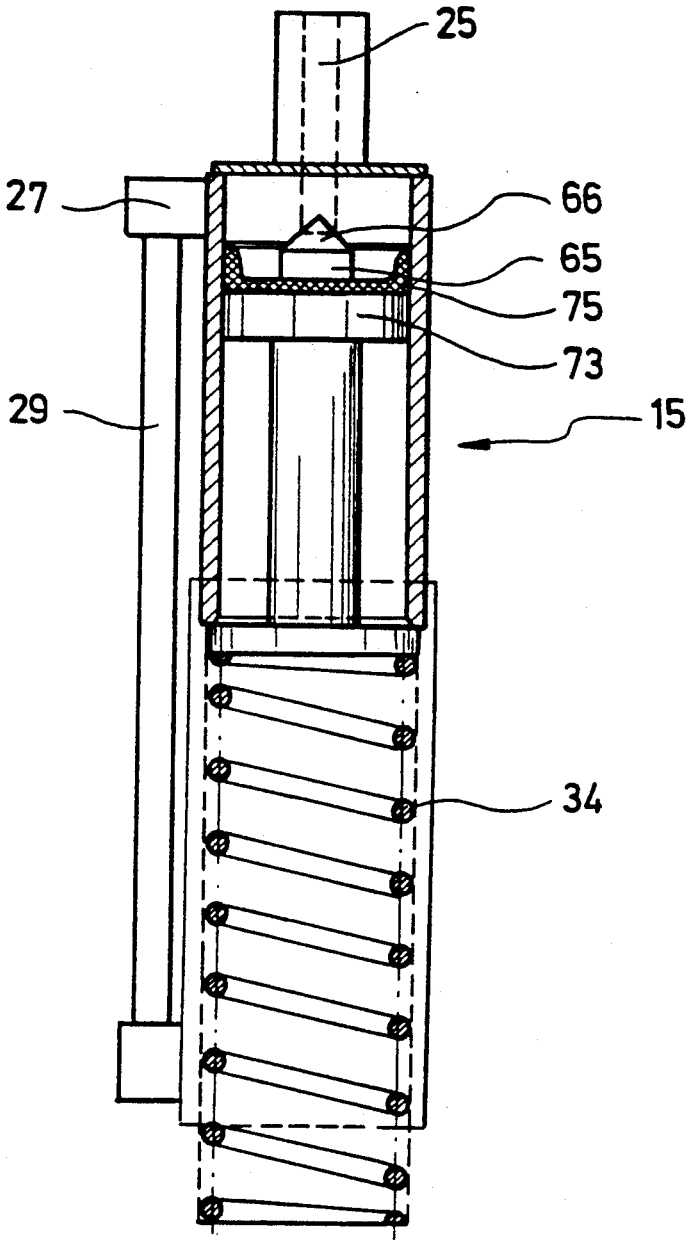
FIG. 7 is an alternative embodiment of the spraying apparatus with a piston.

FIG. 7 shows an alternative embodiment regarding the design of the pump chamber 15. Instead of the bellows 21, use is made of a piston 73 which is slidably arranged in the pump chamber 15. At its upper side facing the pump chamber 15, the piston 73 comprises a sealing sleeve 75 which seals the space located thereabove relative to the piston 73.

Figure 8:
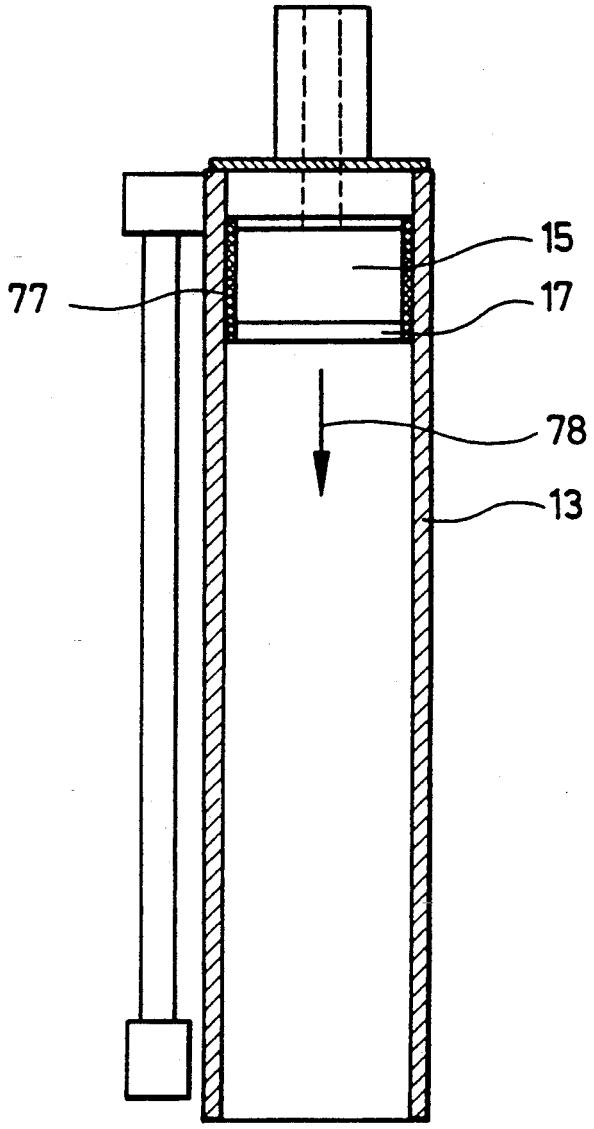
FIG. 8 is another alternative embodiment of the spraying apparatus with a rubber sleeve.

FIG. 8 shows another alternative embodiment of the spraying apparatus comprising a rubber sleeve 77 which is connected to the chamber bottom 17 and which extends substantially along the inner wall of the cylindrical tube 13. When the chamber bottom 17 is lowered in the direction of arrow 78, the rubber sleeve 77 stretches to increase the volume of chamber 15 and to create a counter-pressure or return motion on the chamber bottom 17 according to the expansion thereof, whereby the bottom, in turn, exerts pressure on the material collected in the pump chamber 15. Hence, the rubber sleeve 77 forms the corresponding resetting means 33.

Figure 9:
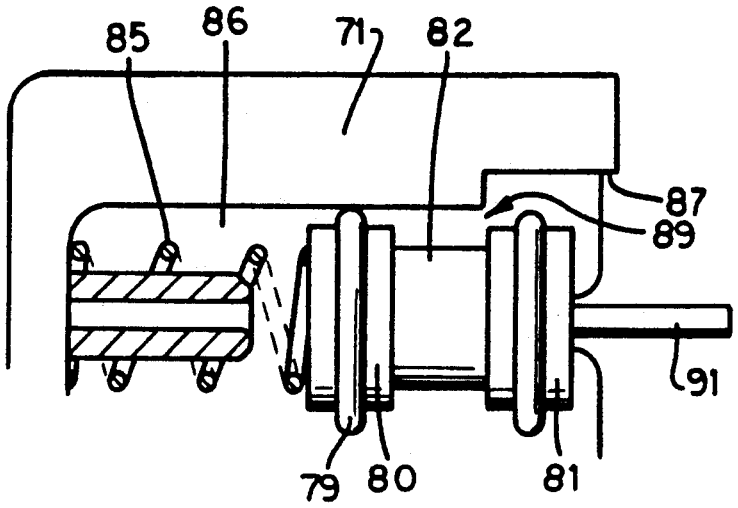
FIG. 9 PRIOR ART
FIG. 9 shows a first a conventional embodiment of pressure regulated spray head usable in the apparatus of FIG. 1, and appropriately labeled "PRIOR ART"
Figure 10:
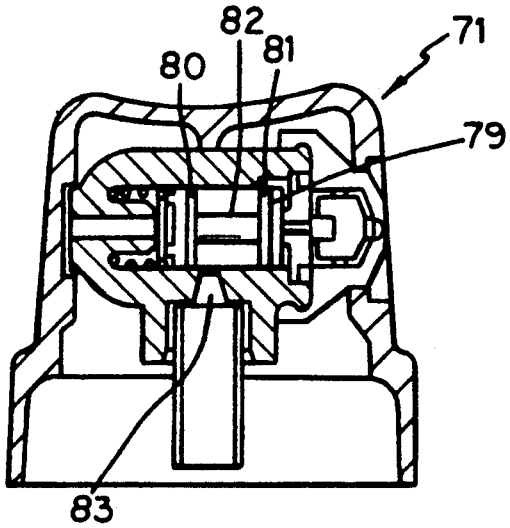
FIG. 10 PRIOR ART
FIG. 10 shows a second embodiment of the pressure-regulation spraying head.

FIG. 9 diagrammatically shows a conventional pressure-regulation spray head 71 as is used in the spraying apparatus of the invention. FIG. 10 is also a diagrammatic illustration of a spraying head similar to the illustration of FIG. 9. The pressure-regulation spray head 71 comprises a twin-type piston 79 including two pistons 80 and 81 that, in turn, are held in spaced-apart relationship by a rod 82. An annular space is formed around the piston rod 82 between the pistons 80 and 81 and communicates with an inlet opening 83 through which the material flows into the space.

The twin-type piston 79 is acted upon at one side with a force which is effective in one direction through a helical spring 85.

A piston chamber 86 receives the piston 79 and has a portion of increased diameter which is formed by a stepped shoulder 87 and which forms an opening 89 through which material can flow. The size of the opening 89 depends on the position of the piston 81 which, in turn, depends on the internal pressure exerted by the material.

When the internal pressure is reduced, the opening 89 is increased, so that substantially the same amount of material flows out through the opening 89 as a rule.

However, when the internal pressure exerted by the material becomes too low, the spring 85 moves the twin-type piston 79 further until the right piston 81 closes the exit opening or spray opening 91. It is thereby ensured that an adequate internal pressure exists when material is dispensed. In cases where an adequate internal pressure within the material no longer exists for a proper spraying action, it is thereby ensured that a spraying operation can no longer be performed.

Figure 11:
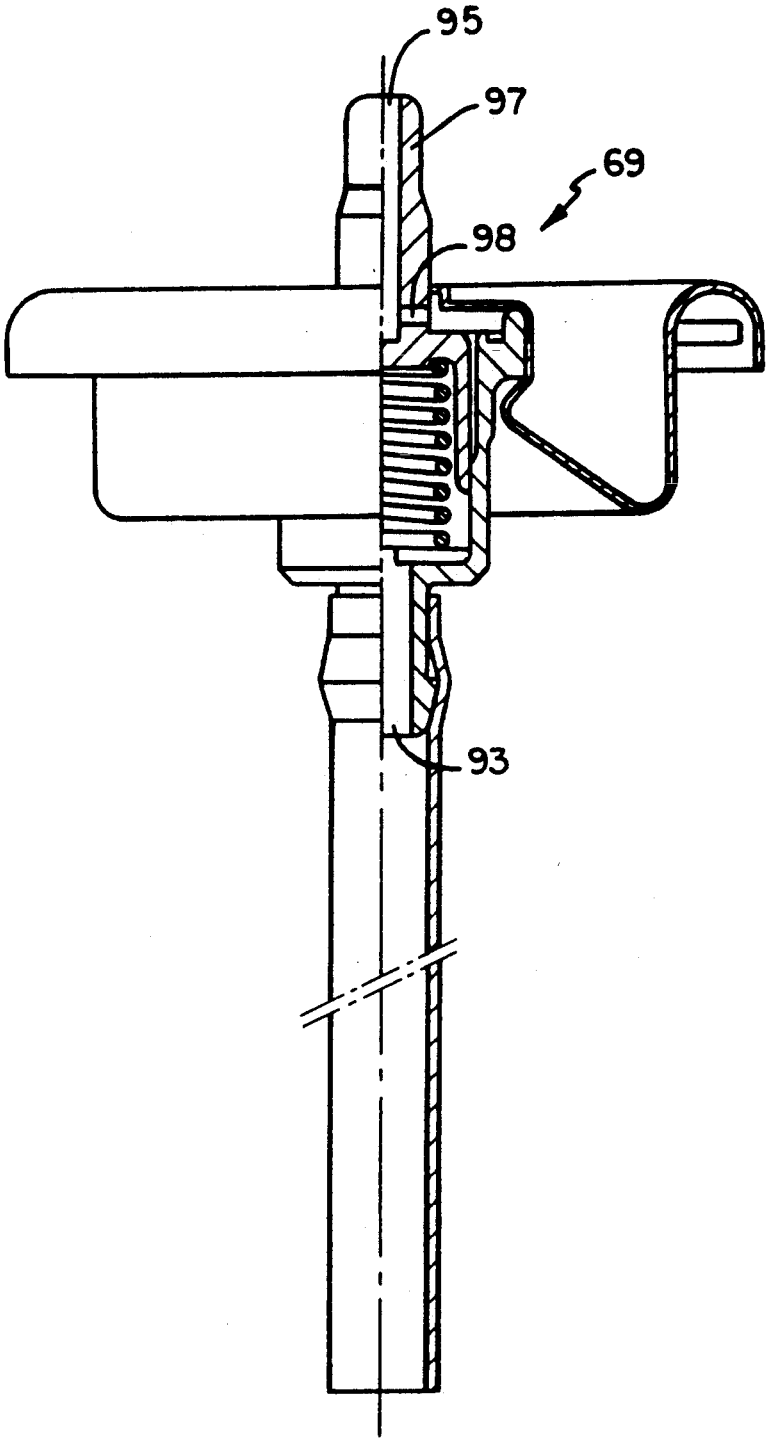
FIG. 11 PRIOR ART
FIG. 11 illustrates a conventional valve assembly used in the spraying apparatus of FIG. 1, appropriately labelled "PRIOR ART"

Finally, FIG. 11 illustrates a conventional valve assembly 69 as can be used in the spraying apparatus of the invention. Since this valve assembly 69 is a conventional valve assembly which one skilled in the art is aware of, a detailed description is not necessary. The valve assembly 69 has an inlet duct 93 and an outlet duct 95, a connection being established between inlet duct 93 and outlet duct 95 by operating the valve rod 97, whereby a hole 98 is released for establishing said connection. In the unloaded state the valve assembly 69 performs a closing action, thereby acting as a nonreturn valve during the sucking operation.

The operation of the spraying apparatus shall now be explained again with reference to FIG. 1. After the pull cord 53 has been pulled out by means of the ball 60, which has the effect that the chamber bottom 17 is moved downwards by means of the actuating cord 37 under simultaneous compression of the spring 34, the material is sucked from chamber 16 and into the pump chamber 15, where it is located within the filled bellows 21.

After the ball 60 has been released, the driving spool 45 is moved back by means of the spiral spring 62 in a direction opposite to the direction of arrow 46, and the pull cord 53 is wound up again. The material within the pump chamber 15 can no longer flow back into the suction conduit 27 due to the nonreturn valve 31. Hence, the chamber bottom 17 remains in its lower position in the still closed state of the spraying head because the material is normally an incompressible medium. It is only when corresponding amounts of the material are being dispensed that the chamber bottom 17 travels upwards again, taking along the actuating cord.

At a predetermined distance of the chamber bottom 17 from the opening 19, the latter is closed by means of the plunger 65, so that material can no longer exit.

Instead of the plunger 65, or in addition to the plunger 65, a shut-off device, as is described with reference to FIGS. 9 and 10, may be provided in the spraying head.

The supply chamber 16 may be connected via an adapter line to a refill the container (not shown). This is of special advantage in the case of large consumers, e.g. in the haircutting craft, because the spraying apparatus can be used again. This helps to reduce costs, but is also beneficial for ecological reasons.

Figure 12:
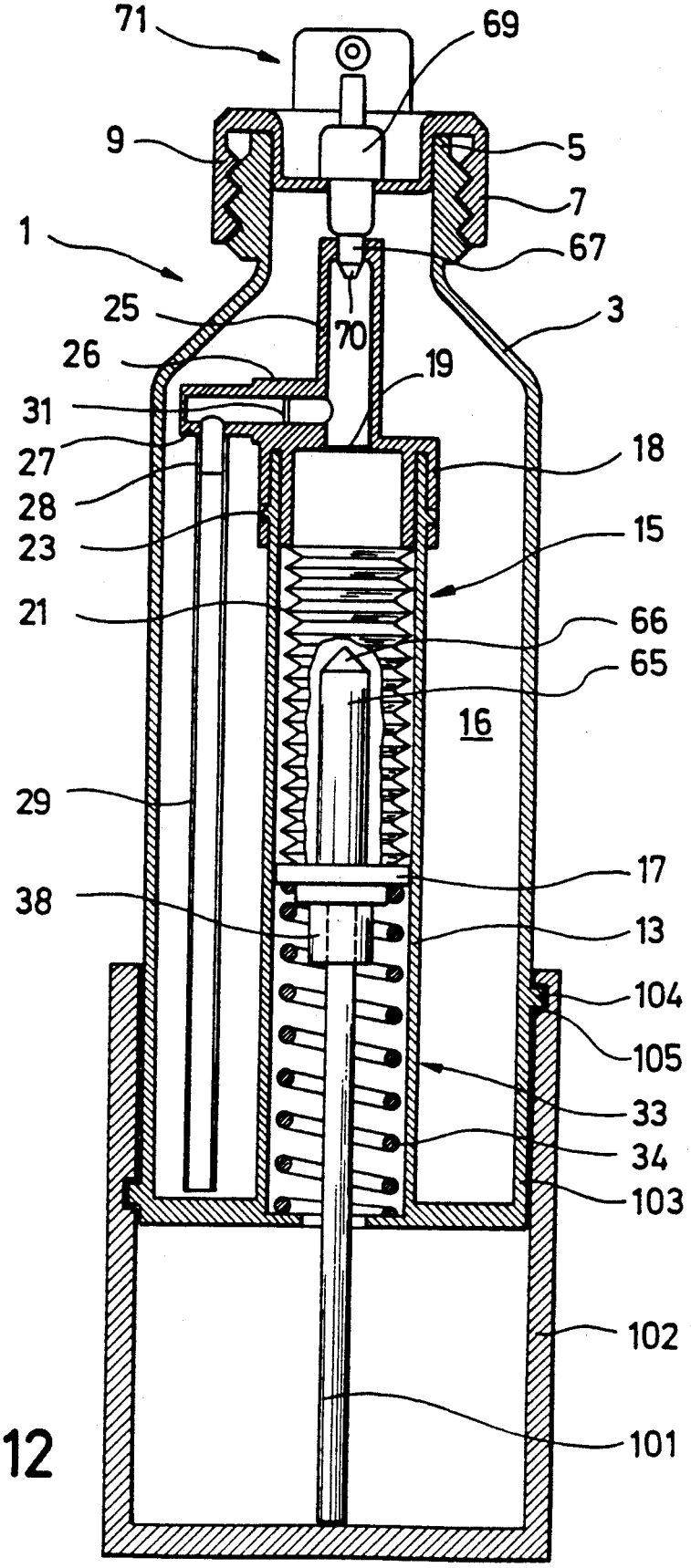
FIG. 12 shows another embodiment of the spraying apparatus.

In another embodiment illustrated in FIG. 12, the chamber bottom 17 is connected via a rod 101 to a cap 102 which covers a lower outer wall portion 103 of the spraying apparatus and is guided by the wall 103. Pins 104 that are in engagement with grooves 105 arranged in the cap 102 are provided on the wall 103. The grooves 105 extend in a helical fashion along the inner wall of the cap, the pitch of the grooves 105 being chosen such that self-locking between grooves 105 and pins 104 is excluded. For suction purposes, the cap 102 is rotated in a direction facing away from the spraying head 71. As a result of the rotation, the chamber bottom 17 moves downwardly against the tension force of the spring 34, whereby material is sucked from the supply chamber 16. When material is being sprayed, the tension force of the spring 34 moves the chamber bottom 17 towards the spraying head 71, with the cap 102 being also moved along. One can see from the position of the cap 102 how much material is within the pressure chamber 15. In an alternative embodiment, the pin 104 may also be provided in the cap 102 and the groove 105 in the wall 103. Instead of one or several pins 104, there may also be a partly or fully formed thread.

It should be noted that a combination of various embodiments is possible. In summary, it should therefore be noted that the spraying apparatus of the invention is a simple and efficient spraying apparatus that guarantees a reliable spraying result.

A pressure compensation between the supply chamber 16 and the surroundings of the spraying apparatus can be accomplished in many ways. For instance, an intended leakage or a corresponding opening in the container wall is possible. A pressure-dependent sealing lip (not shown) is preferably provided. When a certain pressure difference exists between the pressure in the supply chamber 16 and the ambient pressure, this sealing lip performs an opening action for carrying out a corresponding pressure compensation.

I claim:

1. A spraying apparatus comprising a material container having a supply chamber located therein;

a variable volume pressure chamber which stores the material to be sprayed at a pressure higher than the ambient pressure, a bottom of said chamber being movable to vary the volume of said chamber;

spraying head including a manually operated dispensing valve;

a dispensing duct in communication with said pressure chamber and said dispensing valve; a suction conduit connecting said pressure chamber to said supply chamber;

actuating means, cooperating with said pressure chamber, for selectively increasing the volume of said pressure chamber to create a pressure drop in said pressure chamber to suck material from said supply chamber into said pressure chamber;

a nonreturn valve arranged in said suction conduit;

pressurizing means, connected to said pressure chamber, for pressurizing the material within said pressure chamber; wherein said pressurizing means and said actuating means are fastened to said chamber bottom, and said actuating means comprises an actuating cord having one end secured to said chamber bottom and another end secured to a winding spool, said cord being adapted to be wound onto and from said winding spool, said winding spool being arranged in a housing positioned below said material container and being rotatably mounted in said housing, said winding spool being rotatable from outside of said housing by a driving spool which is connected to said winding spool and around which a pull cord is wound, one end of said pull cord being fixed to said driving spool and the other end of said pull cord being adapted to be gripped from outside of said housing.

2. A spraying apparatus according to claim 1, wherein said actuating means and said pressurizing means are coupled with each other.

3. A spraying apparatus according to claim 1, wherein, said actuating means is connected to said chamber bottom via a peg-shaped attachment projecting downwardly from said chamber bottom.

4. A spraying apparatus according to claim 1, wherein said pressurizing means is a spring which decreases the volume of said pressure chamber for pressurizing said material.

5. A spraying apparatus according to claim 1, wherein said end of said pull cord which is adapted to be gripped is connected to a gripping means comprising a ball.

6. A spraying apparatus according to claim 1, wherein said winding spool and said driving spool are made integral and formed as an injection molded part.

7. A spraying apparatus according to claim 1, wherein a diameter of said driving spool is greater than a diameter of said winding spool.

8. A spraying apparatus according to claim 1, further comprising return means for rotating said driving spool to wind up said pull cord onto said driving spool.

9. A spraying apparatus according to claim 8, wherein said return means comprises a spiral spring.

10. A spraying apparatus according to claim 1, wherein said pressurizing means is formed as a rubber sleeve which is arranged inside said pressure chamber and which forms an inner circumferential wall thereof.

11. A spraying apparatus according to claim 1, wherein said pressurizing means is a pressure spring.

12. A spraying apparatus comprising:

a material container having located therein a supply chamber and a pressure chamber, said pressure chamber having a volume which is variable upon translation of a movable element defining a wall of said pressure chamber;

a spraying head mounted on said material container, said spraying head including a dispensing valve;

a dispensing duct connecting said pressure chamber to said dispensing valve;

a suction conduit connecting said pressure chamber to said supply chamber;

a rotatable winding spool;

a cord having a first end connected to said movable element and a second end connected to said winding spool, said cord winding around said winding spool upon rotation of said winding spool to translate said movable element; and a rotatable driving spool which is connected to said winding spool and which, when rotated, causes said winding spool to rotate to cause said cord to wind around said winding spool.

13. A spraying apparatus according to claim 12, wherein said pressure chamber has a cylindrical configuration.

14. A spraying apparatus as defined in claim 12, wherein said movable element comprises a bottom of said pressure chamber.

15. A spraying apparatus according to claim 14, further comprising a helical spring arranged between a bottom of said material container and the chamber bottom of said pressure chamber as a pressurizing means.

16. A spraying apparatus according to claim 14, further comprising a bellows arranged between said chamber bottom and an upper inner side of said pressure chamber for receiving the material to be dispensed.

17. A spraying apparatus according to claim 14, wherein at an upper end said pressure chamber comprises an opening which serves both the introduction and discharge of material.

18. A spraying apparatus according to claim 17, wherein said opening of said pressure chamber can be closed by a plunger extending from said chamber bottom.

19. A spraying apparatus according to claim 14, wherein said pressure chamber bottom is formed as a sealing piston.

20. A spraying apparatus according to claim 12, wherein said spraying head is a pressure-regulation spray head.

21. A spraying apparatus according to claim 20, wherein said pressure-regulation spray head is arranged in a cover of said material container.

22. A spraying apparatus according to claim 21, wherein said cover is detachable.

23. A spraying apparatus according to claim 12, wherein said spraying head is formed as a pressure-regulation spray head which comprises a pressure-dependent shut-off device for shutting off said dispensing conduit.

24. A spraying apparatus as defined in claim 12, further comprising a housing connected to said material container, and wherein said winding spool is positioned within said housing and said driving spool is accessible from outside of said housing.

25. A spraying apparatus as defined in claim 24, wherein said driving spool is positioned within said housing, and further comprising a pull cord which has a first end connected to said driving spool and a second end extending outside of said housing.

* * * * *